United States Patent [19]

Poff, Jr.

[11] Patent Number: 4,653,210

[45] Date of Patent: Mar. 31, 1987

[54] FIREARM BOLT ACTION AND EXTRACTOR

[76] Inventor: Charles R. Poff, Jr., Rte. 1, Box 46B, Boston, Ky. 40107

[21] Appl. No.: 706,877

[22] Filed: Feb. 28, 1985

[51] Int. Cl.[4] ..... F41C 15/12; F41C 11/02

[52] U.S. Cl. ..... 42/16; 42/25

[58] Field of Search ..... 42/16, 25

[56] References Cited

U.S. PATENT DOCUMENTS

| | | | |
|---|---|---|---|
| 557,079 | 3/1896 | Mondragon | 42/16 |
| 1,124,071 | 1/1915 | Stamm | 42/16 |
| 1,352,412 | 10/1920 | Payne | 42/16 |
| 2,147,185 | 2/1939 | Ahern | 42/16 |
| 2,409,569 | 10/1946 | Johnson, Jr. | 42/16 |
| 2,717,535 | 9/1935 | Taylor | 42/16 |
| 2,811,902 | 11/1957 | Dixon | 42/16 |
| 2,941,449 | 6/1960 | Reed | 42/16 |
| 3,027,672 | 4/1962 | Sullivan | 42/25 |
| 3,253,362 | 5/1966 | Gitchell | 42/16 |
| 3,848,351 | 11/1974 | Clark | 42/16 |
| 4,272,902 | 6/1981 | Waters | 42/16 |
| 4,555,860 | 12/1985 | Zedrosser | 42/25 |

FOREIGN PATENT DOCUMENTS

| | | | |
|---|---|---|---|
| 759051/393 | 11/1944 | Austria | 42/16 |

*Primary Examiner*—Deborah L. Kyle
*Assistant Examiner*—Michael J. Carone
*Attorney, Agent, or Firm*—Lalos, Keegan & Kaye

[57] ABSTRACT

This invention relates to a firearm and more particularly to a firearm having a bolt action in which a bolt is arranged for axial and rotational movement in a receiver and an extractor system operable in combination with the movement of the bolt relative to the bolt receiver. The bolt includes lugs having a locking surface which engages a locking wall formed on a cooperating lug on the receiver when the bolt is in the firing position. Both the locking surface and locking wall are arranged at cooperating angles and are conically shaped so as to insure that the axis of the bolt and receiver will be concentric when the bolt is locked in the firing position. In the event of a cartridge rupture the angle of the locking wall causes some of the forces generated by the rupture to be diverted at an angle from the axis, thereby minimizing the shearing stresses on the receiver lugs. The extractor includes a portion arranged as part of the bolt locking surface so that the extractor is mechanically held relative to the bolt when the bolt is in the firing position.

13 Claims, 14 Drawing Figures

FIG. 1
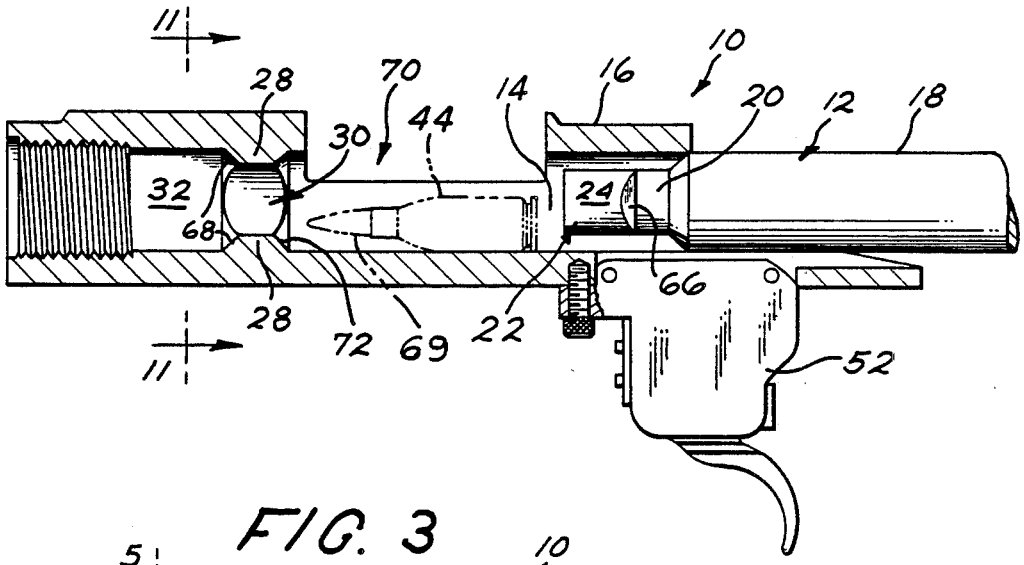
FIG. 3
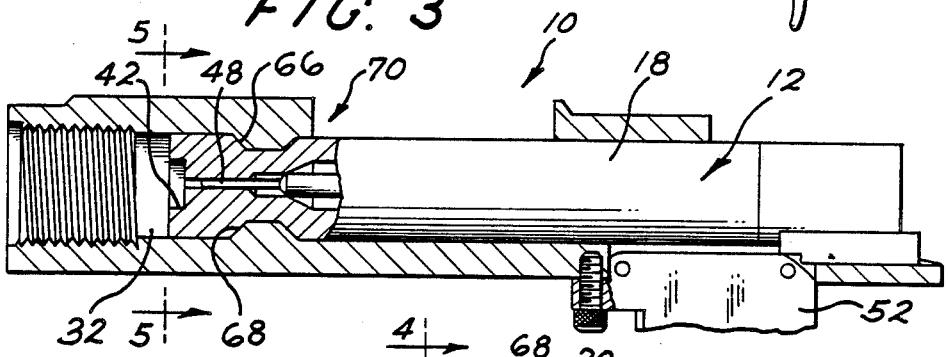
FIG. 4
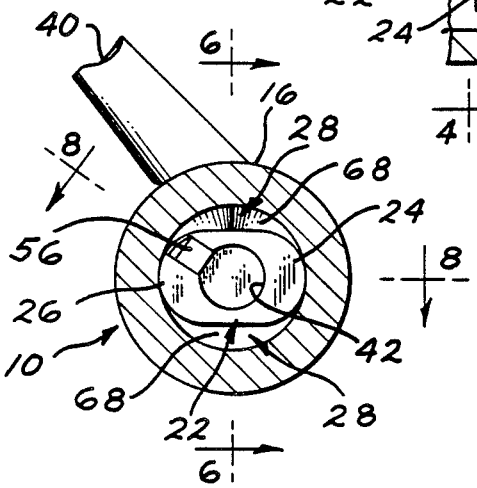
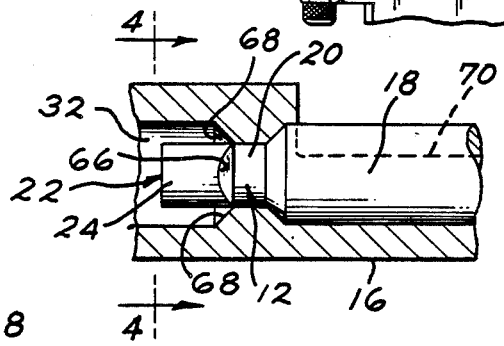
FIG. 2
FIG. 5
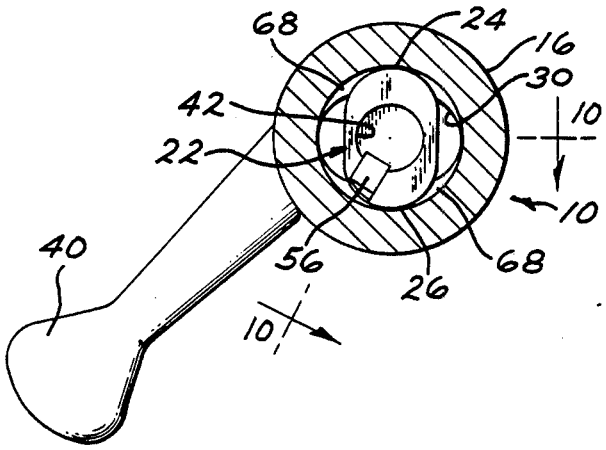

FIG. 8
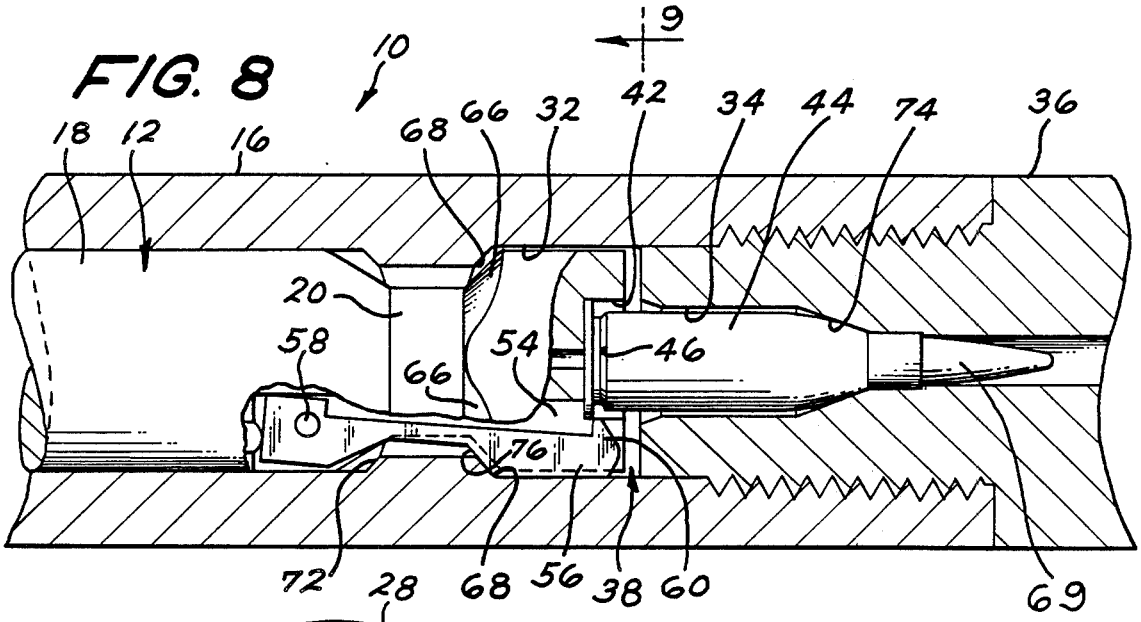
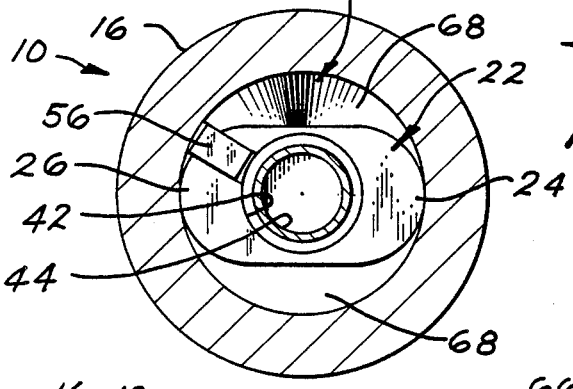
FIG. 9
FIG. 10
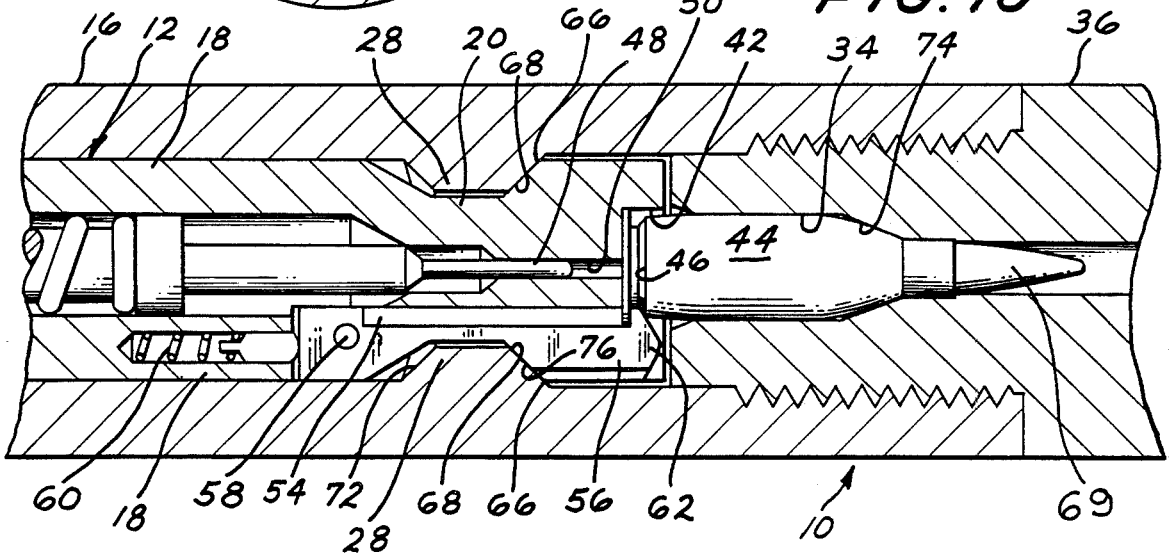

FIG. 12
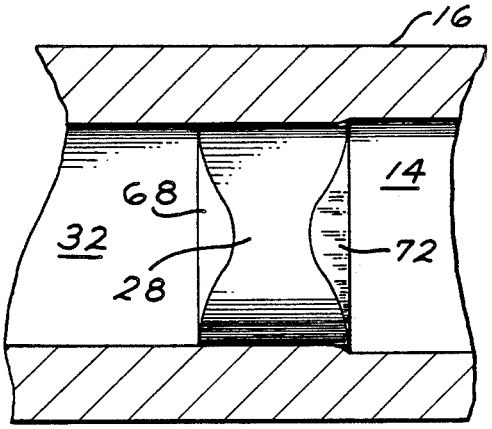
FIG. 13
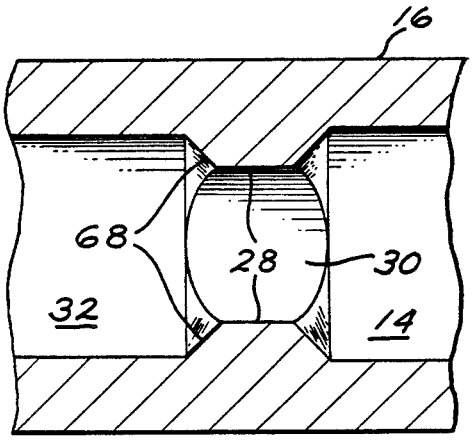
FIG. 11
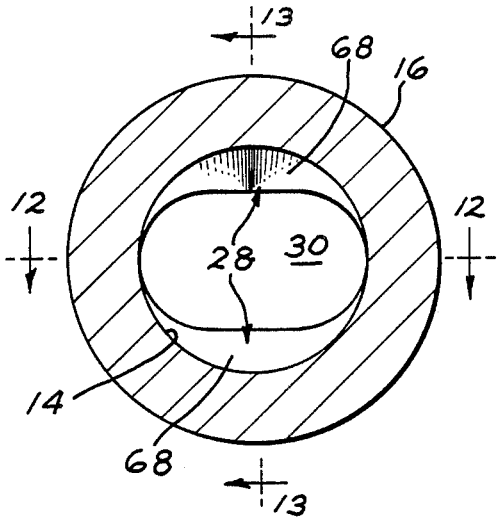
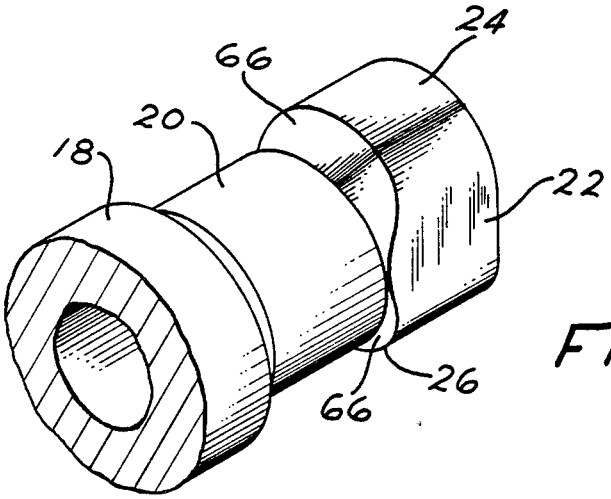
FIG. 14

FIREARM BOLT ACTION AND EXTRACTOR

BACKGROUND OF THE INVENTION

The present invention relates to a firearm and more particularly to an action having a receiver-bolt arrangement. In actions incorporating a bolt which is slidably arranged in a receiver for movement between a cartridge loading and firing position it is customary to form the bolt with lugs having locking surfaces which engage cooperating locking surfaces formed on lugs in the receiver. The locking surfaces on the bolt lugs and the receiver lugs are traditionally oriented in a plane substantially perpendicular to the axis of the bolt and receiver. In locking the bolt relative to the receiver the bolt slides longitudinally so that the locking surfaces on the bolt and receiver are generally in the same plane at which time the bolt is rotated to align and bring the locking surfaces into engagement. This type of arrangement, while providing longitudinal positioning of the bolt relative to the receiver, does in some instances result in the axis of the bolt not being concentric with the axis of the receiver. This occurs due to design tolerances necessary to allow the bolt to slide and rotate relative to the receiver. Due to these tolerances and normal wear the leading end of the bolt may move radially relative to axis of the receiver. Since the cartridge is supported at the leading end of the bolt a misalignment of the axis of the bolt relative to the receiver will cause cartridge to be out of axial alignment as well. If the cartridge is out of axial alignment relative to the receiver, it is put under stress by the bolt when it is secured in its firing position. This resulting stress on the cartridge casing will in effect cause the rifle barrel to deflect during firing which results in the trajectory of the projectile being off-target.

Further, when the locking surface of the receiver lug is substantially perpendicular to the axis of the receiver, the rupturing of the cartridge will cause substantially all of the stress forces to impact on the lug. Since these forces are generally in the 40K to 60K LPS the lug may shear from the receiver or deform. This can result in the bolt either jamming in the receiver or blowing out of the rear end of the action.

It is also customary in prior art bolt actions to provide an extractor which is maintained in its cartridge lock position by spring action. In this arrangement because of tolerance needed between the bolt and receiver it is possible for the extractor to move relative to the bolt and cartridge when the bolt is in the firing position. In this prior art design when a cartridge ruptures it often results in the extractor jamming in the firing chamber thereby causing damage to the bolt and difficulty in retrieving the spent cartridge.

SUMMARY OF THE INVENTION

By the present invention there is provided a bolt assembly for a firearm for firing a round of ammunition including a cartrige case. The bolt assembly includes a receiver having a cartridge firing chamber formed with a cylindrical interior wall. A bolt is arranged in the receiver for longitudinal movement between a cartridge loading position and a cartridge firing position wherein the bolt is rotated to a locked cartridge firing chamber. The bolt has a cylindrical body portion including a front portion having an elongated cross-section and a narrowed portion intermediate the cylindrical body portion and the elongated front portion.

Locking means formed on the cylindrical interior wall define a mortise opening dimensioned for allowing passage of the elongated front portion of the bolt into firing chamber, and for allowing rotational movement of the narrowed portion of the bolt while the elongated front portion is in the firing chamber. The locking means includes a generally conically oriented locking wall engaging cooperatively conically oriented locking surface formed on the rear end of the elongated front portion of the bolt. Formed in the front face of the elongated front portion of the bolt is a recess dimensioned for receiving the cartridge case. A peripheral extractor groove is formed in the bolt and extends longitudinally from a portion in the cylindrical body portion to the free end of the elongated front portion of the bolt. Disposed in the groove is an extractor having an outer surface conforming with the outer surface of the bolt between the cylindrical body portion and the elongated front portion including a section forming part of the locking surface of the bolt. A holding tab formed on the extractor head is arranged for engaging the cartridge case when it is positioned in the recess. The extractor is biased in a first position in the groove so that the holding tab formed on the extractor head will move to allow the cartridge case to be received in the recess when the front portion of the bolt is in the firing chamber prior to the bolt's rotation to the locked position. Accordingly, in the firing position the generally conically oriented locking surface on the bolt including the section of the extractor at the rear end of the elongated front portion of the bolt intimately engage the cooperating generally conically oriented locking wall on the interior wall of the receiver. This engagement serves to secure and concentrically align the axis of the bolt relative to the receiver and to prevent pivoting of the extractor relative to the bolt so that the holding tab is retained in engagement with the cartridge case in the firing position.

BRIEF DESCRIPTION OF THE DRAWINGS

FIG. 1 is a fragmentary side elevational view showing the action embodying the present invention with the bolt in a cartridge loading position;

FIG. 2 is a fragmentary view showing the bolt partially in the firing position;

FIG. 3 is a view similar to FIG. 1 showing the action with the bolt in the cartridge firing position;

FIG. 4 is a sectional view taken along line 4—4 of FIG. 2;

FIG. 5 is a sectional view taken along line 5—5 of FIG. 3;

FIG. 8 is a view taken along line 8—8 of FIG. 4 showing the extractor cammed to its open position by the cartridge;

FIG. 9 is a sectional view taken along line 9—9 of FIG. 8 showing the extractor in its open position;

FIG. 10 is a sectional view taken along line 10—10 of FIG. 5 showing the bolt locked in the firing position;

FIG. 11 is a view taken along line 11—11 of FIG. 1 showing the locking wall on the receiver of the action;

FIG. 12 is a fragmentary plan view taken along line 12—12 of FIG. 11 showing a locking wall on the receiver of the action;

FIG. 13 is an elevational view taken along line 13—13 of FIG. 11; and

FIG. 14 is a perspective view of the bolt showing the locking surfaces.

DESCRIPTION OF THE PREFERRED EMBODIMENT

Figure 6:
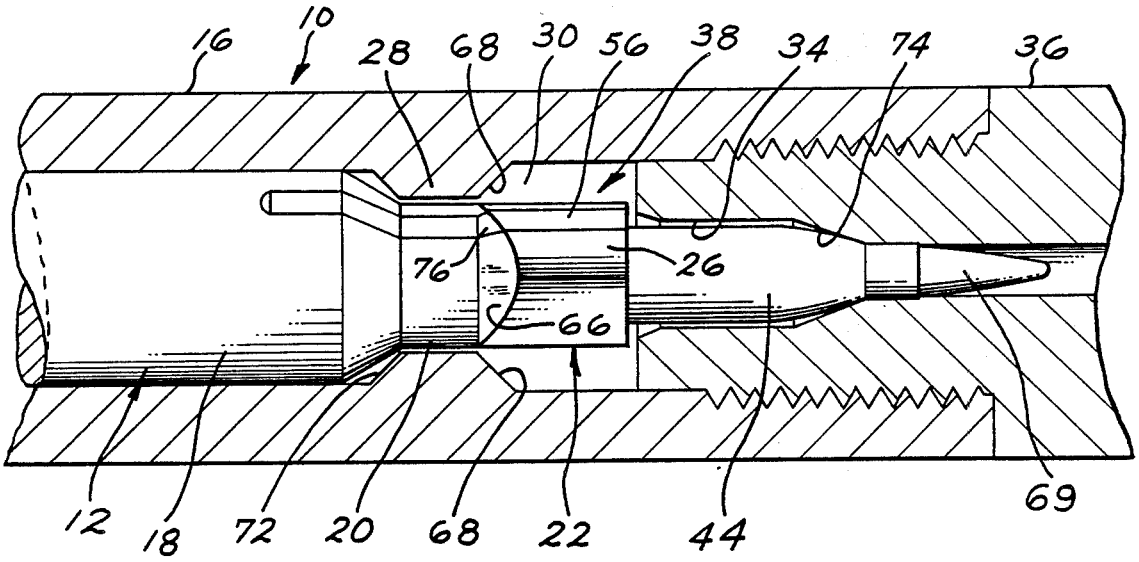
FIG. 6 is a sectional view taken along line 6—6 of FIG. 4 showing a barrel connected to the rifle action and the bolt partially inserted into the firing chamber.

While in the present embodiment the illustrated invention is shown as applied to a rifle action it should be understood that the invention, as will be described hereinafter, may be applied to any type of locked breach firearm. Referring now to the drawings, it will be seen that the bolt action 10 of the present invention includes a generally cylindrical bolt 12 arranged in a generally cylindrical recess 14 of a receiver 16.

The bolt 12 slidably fits into the recess 14 of the receiver 16. In the illustrative embodiment the bolt 12 includes a cylindrical body 18, a narrowed cylindrical portion 20 and an elongated front head section 22, which provides diametrically oriented lugs 24 and 26 as best seen in FIGS. 4, 5 and 14. The interior side wall of recess 14 of the receiver 16 is formed to include opposed lugs 28 forming a mortise opening or groove 30 dimensioned to allow the elongated front head section 22 of the bolt 12 to pass therethrough to the firing position as shown in FIGS. 2 and 10.

This arrangement allows the elongated bolt head 22 to pass through the mortise opening 30 to a cartridge chamber or breach area 32 which together with a breecharea 34 in the barrel 36 forms a firing chamber 38. The dimension of the radial ends of the elongated head portion 34 is substantially the same as the cylindrical body portion 18 of the bolt 12 so that the lugs 24,26 engage lugs 28 in a manner to be explained hereinafter. For the manipulation of the bolt 12 there is a usual bolt handle 40 which works in a recess (not shown) in the wall of the receiver 16.

The front face of head 22 of the bolt 12 as shown in FIGS. 8 and 10 is provided with a recess 42 which is dimensioned to accommodate a cartridge 44. The base of the cartridge 44 is provided with an annular holding groove 46 which as will be explained hereinafter is employed to engage the cartridge for subsequent extraction of the cartridge from the firing chamber. A firing pin 48 (FIG. 10) extends rearwardly from the recess 42 in the rear end of the bolt 12 through an axial bore 50. The firing pin 48 may be released to fire the cartridge 44 through a trigger mechanism 52 in any known manner and does not form a part of this invention.

The barrel 36 as shown in the drawing is suitably secured, usually threaded on the end of the breach area 32 to the receiver 16 of the action 10. It should be noted that the accuracy of the rifle depends on the concentricity of the receiver and barrel axis. As mentioned hereinabove, the barrel breach 34 and the cartridge chamber 32 in the present invention will be referred to as the firing chamber 38 into which the cartridge 34 is positioned in the firing position.

The bolt 12 is further provided with a longitudinally extending extractor groove 54 (FIGS. 8 and 10) which extends from the cylindrical body portion 18 of bolt 12 through the narrowed portion 20 and the elongated front portion 22 to the end of the bolt 12. Arranged in the extractor groove 54 is an extractor 56. The extractor 56 is pivoted at its rearward end 58 in the bolt body 12 and is biased radially inwardly by a spring 60 so as to remain within the radial dimension of the bolt 12. The free or forward end of the extractor 56 is provided with a hook or holding portion 62 which is dimensioned to engage the annular holding groove 46 of the cartridge 44. As will be explained fully hereinafter, the extractor 56, as is customary, functions to extract the cartridge 44 from the firing chamber 38 after the firing operation. Accordingly, as will be explained fully hereinafter means are provided by the present invention which insure that the extractor 56 engages the cartridge 44 during the firing operation and is operative to insure removal of the cartridge case 44 after the firing operation.

In operation with the bolt 12 in its retracted position as shown in FIG. 1 a cartridge 44 is placed in the recess 14 of the receiver 16. As the bolt 12 moves from the cartridge loading position shown in FIG. 1 to the cartridge firing position shown in FIGS. 6–8 and 10 the bolt head pushes the cartridge 44 through the mortise opening 30 after which the leading edge of the elongated head portion 22 of bolt 12 passes through the mortise opening 30 between the two locking projections 28 in the recess 14 of receiver 16. Once the head or elongated portion 22 of the bolt 12 is in the breach area 32 the bolt through handle 40 is rotated so that the elongated head 22 rotates relative to the mortise opening 30 to a position wherein the lugs 24,26 of the elongated head portion 22 are axially aligned with the lugs 28 on the receiver 16. The alignment of the lugs 28 with the lugs 24,26 prevent longitudinal movement of the bolt 12 relative to the receiver 16. As thus far described the action of the bolt 12 relative to the receiver 16 is similar to prior art bolt actions.

By the present invention means are provided to insure that the axis of the bolt 12 and receiver 16 are concentric when the bolt is locked in the firing position. To this end, the trailing end of the lugs 24,26 of the bolt 12 are provided with generally conically oriented locking or support surfaces 66. Cooperatively arranged relative to the surfaces 66 are generally conically oriented locking or support surfaces 68 formed on the forward ends of the lugs 28. As a result of the generally conically oriented supporting surfaces 66 on the bolt 12 cooperating with the complementary conically oriented supporting surfaces 68 on the receiver 16 the concentricity between the bolt and receiver is assured when the bolt is in the firing position.

Accordingly, when the bolt is locked in firing position the two locking surfaces 66,68 are in maximum engagement, and the axis of the bolt 12 is concentric with the axis of the receiver 16. The generally conially oriented cooperative surfaces 66 and 68 insure that the axis of the receiver 16 is always concentric with the axis of the bolt 12 when the bolt is in the firing position. In prior art devices employing locking arrangement having locking surfaces which are perpendicular to the axis of the receiver it is possible for the axis of the bolt to be out of alignment with the axis of the receiver. This misalignment of the bolt and receiver axis will cause the cartridge 44 to be out of axial alignment with the barrel and accordingly stresses in the cartridge 44 when it is locked in the firing position. The resulting stresses on the cartridge body 44 can cause the trajectory of the projectile 69 to be off-target. The present invention by insuring concentricity of the axis of the bolt 12 and receiver 16 will insure alignment of the cartridge with the barrel breach 34 and eliminate placing stresses on the cartridge body 44. The misalignment of the cartridge 44 and the undue stress placed on the cartridge by the axial misalignment of the bolt and receiver can actually cause a dispersement or deflection of the barrel 36. Deflection of the barrel will cause the trajectory to be off-target. It should further be understood that by orienting the locking surfaces 66 and 68 at an angle relative to the plane perpendicular to the axis of the bolt and receiver it in effect increases the area of the locking surfaces.

Figure 7:
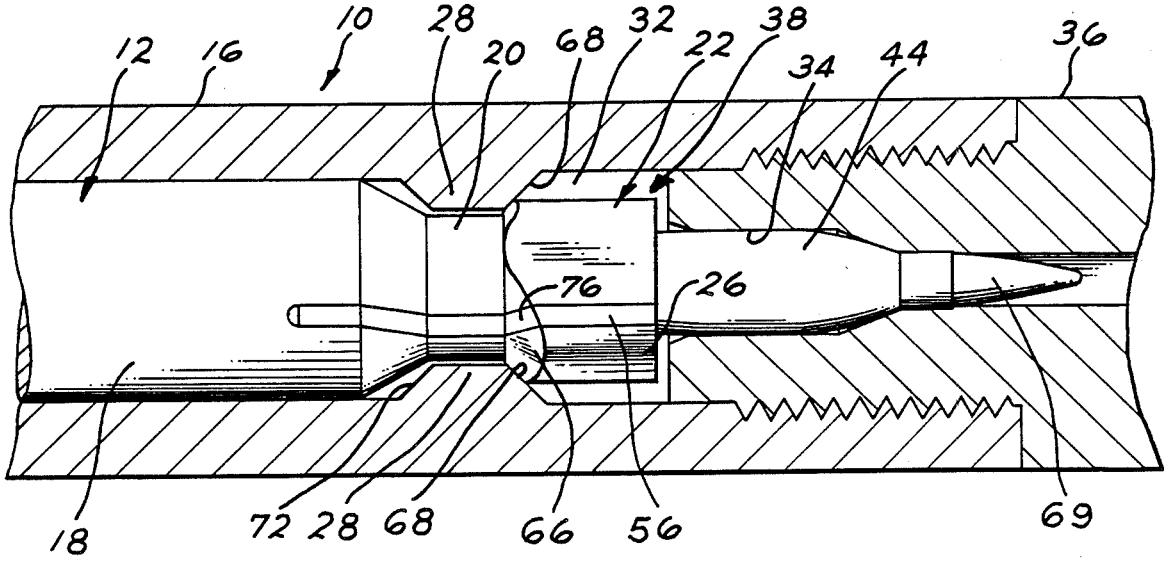
FIG. 7 is a view similar to FIG. 6 showing the bolt rotated to an initial locked position.

In operation of the action 10 when the bolt 12 is in the firing position the rotation of the bolt to the locked position results in contact between the locking surfaces 66 and 68 moving very rapidly from minimum contact shown in FIG. 7 to the maximum surface contact when the bolt is fully rotated and locked in the firing position shown in FIGS. 3 and 10. Further, if the bolt head 22 isn't all the way in the breach area, the angle of the surfaces 66 relative to surfaces 68 will act as a lead or cam lead to insure the seating or the compression of the cartridge in the breach of the rifle as shown in FIGS. 7 and 10. In retracting the bolt 12 and more particularly the head 22 from the breach area or firing position the supporting surfaces 66,68 move very rapidly from maximum to minimum contact. This rapid decrease in friction between the surfaces 66 and 68 makes retrieving the bolt very easy, especially when th surfaces are galled.

As mentioned above in loading the cartridge 44 in the action for firing, the cartridge is inserted into the recess 14 of receiver 16 through the case loading opening 70 (FIG. 1). At this point the bolt 12 is moved forward and the cartridge 44 is pushed up a ramp 72 at the rear portion of lugs 28 and through opening 30. The bolt 12 continues forward until the forward or projectile end 69 of the cartridge 44 actually contacts shoulder 74 of the barrel breach area 34. This contact of the cartridge causes the front end of hook 62 of the extractor 56 to be cammed open by the cartridge 44 as shown in FIG. 8 and the cartridge to pass under and be engaged by the extractor hook 62 as shown in FIG. 7. Continued forward and rotational movement of the bolt 12 compresses the cartridge 44 as shown in FIG. 10 into the fully locked position as the bolt 12 is turned to the firing position. In operation in the event that the extractor hook 62 doesn't pass over the cartridge flange and into groove 46, the rotation of the bolt 12 and the engagement between the support surfaces 66 on the bolt 12 and support surfaces 68 of the receiver 16 will in effect cam the extractor 56 to the closed position. It should be understood that the axial dimension between the shoulder portion 74 of the barrel breach 34 and the support surface 68 of the receiver 16 relative to dimension of the cartridge employed is such that the cartridge casing 44 will in effect be slightly compressed when the bolt is in its locked position.

In the present invention the extractor 56 is cammed by the cartridge and the cartridge locked under the extractor hook 62 at the time the cartridge engages shoulder portion 74 of the barrel breach 34. This takes place as shown in FIG. 7 just prior to the bolt being rotated into the locked position as shown in FIG. 10. In accordance with the present invention means are provided to insure that the extractor hook 62 is not dislodged during the time the bolt is in its locked position. To this end, the outer surface of the extractor 56 is dimensioned to conform to the outer surface of the bolt 12. More particularly a portion 76 of the extractor is in fact part of the locking surface 66 of the bolt. Accordingly, when the bolt is in the locked position the extractor portion 76 forming a part of surface 66 engages the locking cam surface 68 on the receiver 16. This mechanical contact between portion 76 and surface 68 prevents pivoting movement of the extractor 56 during the time the bolt is in the firing position. In the event a cartridge ruptures during firing, the back pressure exerted in the receiver and more particularly on the bolt 12 and extractor can exceed 40,000 psi. This relatively high pressure can cause the extractor 56 to either break or jam making removal of the cartridge difficult or can cause damage to the bolt and receiver. As mentioned above and as shown in FIGS. 6–8 and 10 the portion 76 of the extractor 56 forms an integral part of the locking surface 66 of bolt 12. Accordingly, when the bolt 12 is in its locked position as shown in FIG. 10 the portion 76 of extractor 56 is firmly and mechanically held by engagement of the locking surfaces 66 and 68. By mechanically locking the extractor as shown in the present embodiment relative to the receiver wall rupturing of the cartridge casing 44 and the resulting blow back of pressure on the extractor 56 has little or no effect on the extractor since it is mechanically backed by the receiver wall.

It should also be noted that by providing receiver locking surfaces which are at an angle relative to a plane perpendicular to the axis of the receiver the forces exerted by the cartridge rupturing are dissipated at an angle to the axis to thereby reduce the shear forces on the receiver lugs 28. By reducing the stress forces on the lugs 28 the shearing of the lugs and possible damage thereto is prevented. The shearing of the lugs or damage can result in the bolt jamming or even being driven out the rear end of the action. Accordingly, by the present invention means are provided which prevent damage to the action by the forces generated by a ruptured cartridge.

In summary, a firearm action is provided by the present invention in which the axis of the bolt will be concentric with the axis of the receiver when the bolt is locked in the firing position while at the same time insuring that the extractor is mechanically locked. Further, the system of insuring concentricity of the bolt and receiver by employing generally conically oriented locking surfaces on the locking lugs causes the stress forces on the lugs to be diverted at an angle to the axis of the receiver thereby minimizing the impact on the lugs during normal cartridge firing operation and particularly in the event of a cartridge rupture.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. A bolt assembly, for a firearm, for firing a cartridge, said bolt assembly comprising:

a receiver having an axis and including a cartridge firing chamber having a cylindrical interior wall;

a bolt having an axis and longitudinally slidable in and rotatably arranged in said receiver movable between a cartridge loading position and a firing position, said bolt having a cylindrical body portion including a front portion having an elongated cross-section and a rear end;

locking means formed on said interior wall defining a mortise opening dimensioned for allowing passage of said front portion of said bolt into said cartridge firing chamber during movement of said bolt to said cartridge firing chamber, and having a forward end and for allowing rotational movement of said bolt in said mortise opening when said front portion is in said cartridge firing chamber; and cooperating locking surfaces on the rear end of said front portion of said bolt and the forward end of said locking means conical in shape for concentrically holding said bolt relative to said receiver, and said forward end of said locking means being an angle sufficient to divert forces caused when said cartridge is fired in said chamber.

2. A bolt assembly, for a firearm, for firing a cartridge, said bolt assembly comprising:

a receiver having an axis and including a cartridge firing chamber having a cylindrical interior wall;

a bolt having an axis and longitudinally slidable in and rotatably arranged in said receiver movable between a cartridge loading position and a firing position, said bolt having a cylindrical body portion including a front portion having an elongated cross-section and a rear end;

locking means formed on said interior wall defining a mortise opening dimensioned for allowing passage of said elongated front portion of said bolt into said cartridge firing chamber during movement of said bolt to said cartridge firing chamber and having a forward end, and for allowing rotational movement of said bolt in said mortise opening when said elongated front portion is in said cartridge firing chamber; and cooperating locking surfaces on the rear end of said front portion of said bolt and the forward end of said locking means are arranged at an angle relative to a plane perpendicular to the axis of said bolt and said receiver respectively and defining a conical shape for concentrically holding said bolt relative to said receiver and the angle of said forward end of said locking means relative to a plane perpendicular to the axis of said bolt being sufficient to divert forces caused when said cartridge is fired in said chamber.

3. The bolt assembly recited in claim 2 wherein ammunition for use with the firearm includes a cartridge case and said bolt is formed to include a recess at its forward end for receiving such cartridge case when said bolt is in said firing position.

4. The bolt recited in claim 3 further including:

the front portion of said bolt having a free end, a peripheral extractor groove formed in said bolt extending longitudinally from a portion in said cylindrical body portion to the free end of said elongated front portion;

an extractor head on said extractor, an extractor pivotally disposed in said groove having an outer surface conforming with the outer surface of said bolt between said cylindrical body portion and said elongated front portion including a section forming part of said locking surface, a hold tab formed on said extractor head arranged for engaging said cartridge case in said recess;

said extractor being biased in a first position in said groove in which said holding tab formed on the extractor head will yield to allow said cartridge case to be received in said recess when said bolt is moved to said firing position; and whereby during rotation of said bolt in said firing position said locking surface of said bolt including said section of said extractor at the rear end of said elongated front portion of said bolt intimately engages said locking surface at the forward end of said locking means to secure said bolt relative to said receiver and prevent pivoting of said extractor to thereby retain said holding tab in engagement with said cartridge case when said bolt is in said firing position.

5. A bolt assembly, for a firearm, for firing a cartridge, said bolt assembly comprising:

a receiver having an axis and including a cartridge firing chamber having a cylindrical interior wall;

a bolt having an axis and longitudinally slidable in and rotatably arranged in said receiver movable between a cartridge loading position and a firing position, said bolt having a cylindrical body portion including a front portion having an elongated cross-section and a rear end;

locking means formed on said interior wall defining a mortise opening dimensioned for allowing passage of said front portion of said bolt into said cartridge firing chamber during movement of said bolt to said cartridge firing chamber, and having a forward end and for allowing rotational movement of said bolt in said mortise opening when said front portion is in said cartridge firing chamber; and cooperating locking surfaces on the rear end of said elongated front portion of said bolt and the forward end of said locking means being generally conically shaped and dimensioned for concentrically supporting said bolt relative to said receiver when said bolt is in said firing position.

6. The bolt assembly recited in claim 5 wherein said cylindrical body portion of said bolt further includes a narrowed cylindrical section intermediate said elongated front portion, and said cylindrical body portion is shaped and dimensioned to permit rotational movement in said mortise opening.

7. A bolt assembly, for a firearm, for firing a cartridge, said bolt assembly comprising:

a receiver including a cartridge firing chamber having a cylindrical interior wall;

a bolt longitudinally slidable in and rotatably arranged in said receiver movable between a cartridge loading position and a firing position, said bolt having a cylindrical body portion including a front portion having a rear end and an elongated cross-section;

locking means formed on said interior wall having a forward end defining a mortise opening dimensioned for allowing passage of said front portion of said bolt into said chamber during movement of said bolt to said cartridge firing chamber, and for allowing rotational movement of said bolt in said mortise opening when said front portion is in said cartridge firing chamber;

cooperative locking surfaces on the rear end of said front portion of said bolt and the forward end of said locking means for concentrically supporting said bolt relative to said receiver when said bolt is in said firing position;

a locking wall at the forward end, said locking means being conically shaped and thus at an angle relative to a plane perpendicular to the axis of cylindrical interior wall; and whereby during rotation of said bolt in said firing position said locking surface on said bolt at the rear end of said front portion engages said locking wall at the forward end of said locking means to cam said bolt into firing position and concentrically align the axis of said bolt and said receiver.

8. A bolt assembly, for a firearm, for firing a cartridge, said bolt assembly comprising:

a receiver including a cartridge firing chamber having a cylindrical interior wall;

a bolt longitudinally slidable in and rotatably arranged in said receiver movable between a cartridge loading position and a firing position, said bolt having a cylindrical body portion including a front portion having a rear end and an elongated cross-section and a locking surface at the rear end of said elongated front portion;

said locking surface being oriented at an angle relative to a plane perpendicular axis of said bolt;

locking means formed on said interior wall having a forward end defining a mortise opening dimensioned for allowing passage of said elongated front portion of said bolt into said chamber during movement of said bolt to said cartridge firing chamber, and for allowing rotational movement of said bolt in said mortise opening when said elongated front portion is in said cartridge firing chamber;

cooperative locking surfaces on the rear end of said elongate front portion of said bolt and the forward end of said locking means for concentrically supporting said bolt relative to said receiver when said bolt is in said firing position;

a locking wall at the forward end, said locking means being oriented at an angle relative to a plane perpendicular to the axis of cylindrical interior wall;

whereby during rotation of said bolt in said firing position said locking surface on said bolt at the rear end of said elongated front portion engages said locking wall at the forward end of said locking means to cam said bolt into firing position and concentrically align the axis of said bolt and said receiver; and said locking surface on said elongated front portion of said bolt and said locking wall on said locking means provide cooperating generally conically shaped supporting surfaces for concentrically supporting said bolt relative to said receiver.

9. The bolt assembly recited in claim 8 wherein ammunition for use with the firearm includes a cartridge case and said bolt is formed to include a recess at its forward end for receiving said cartridge case when said bolt is in said firing position.

10. The bolt recited in claim 9 wherein:

a peripheral extractor groove formed in said bolt extending longitudinally from a portion in said cylindrical body portion to the free end of said elongated front portion;

an extractor pivotally disposed in said groove having an outer surface conforming with the outer surface of said bolt between said cylindrical body portion and said elongated front portion including a section forming part of said locking surface, a holding tab formed on said extractor head arranged for engaging said cartridge case in said recess;

said extractor being biased in a first position in said groove in which said holding tab formed on the extractor head will yield to allow said cartridge case to be received in said recess when said bolt is in said firing position; and whereby during rotation of said bolt in said firing position said locking surface on said bolt including said section of said extractor at the rear end of said elongated front portion of said bolt intimately engage said locking wall at the forward end of said locking means to secure said bolt relative to said receiver and prevent pivoting of said extractor to thereby retain said holding tab in engagement with said cartridge case when said bolt is in said firing position.

11. A bolt assembly for a firearm, for firing a cartridge including a cartridge case, said bolt assembly comprising:

a receiver including a chamber having a cylindrical interior wall;

a bolt longitudinally slidable in and rotatably arranged in said receiver movable between a cartridge loading position and a cartridge firing position wherein said cartridge is in said chamber, said bolt having a cylindrical body portion including a front portion having an elongated cross-section and a locking surface at the rear end of said front portion;

said locking surface being oriented at an angle relative to a plane perpendicular to the axis of said bolt;

locking means formed on said interior wall defining a mortise opening dimensioned for allowing passage of said front portion of said bolt into said chamber, and for allowing rotational movement of said bolt while said front portion is in said chamber;

a locking wall on said locking means being oriented at an angle relative to a plane perpendicular to the axis of said cylindrical interior wall;

a recess formed in the axial end of said front portion for receiving said cartridge case;

a peripheral extractor groove formed in said bolt extending longitudinally from a portion in said cylindrical body portion to the free end of said front portion;

an extractor pivotally disposed in said groove having an outer surface conforming with the outer surface of said bolt between said cylindrical body portion and said front portion including a section forming part of said locking surface, a holding tab formed on said extractor head arranged for engaging said cartridge case in said recess;

said extractor being biased in a first position in said groove in which said holding tab formed on the extractor head will yield to allow said cartridge case to be received in said recess when said bolt is in said firing position;

whereby during rotation of said bolt in said firing position said locking surface on said bolt including said section of said extractor at the rear end of said front portion of said bolt intimately engage said locking wall at the forward end of said locking means to secure said bolt relative to said receiver with the axis of said bolt and receiver being concentric and prevent pivoting of said extractor to thereby retain said holding tab in engagement with said cartridge case in said firing position, and said locking surface on said front portion of said bolt and said locking wall on said locking means provide cooperating generally conically shaped supporting surfaces for concentrically supporting said bolt relative to said receiver.

12. A bolt assembly, for a firearm, for firing a cartridge including a cartridge case, said bolt assembly comprising:

a receiver including a chamber having a cylindrical interior wall;

a bolt longitudinally slidable in and rotatably arranged in said receiver movable between a cartridge loading position and a cartridge firing position wherein said cartridge is in said chamber, said bolt having a cylindrical body portion including a front portion having an elongated cross-section and a locking surface at the rear end of said front portion;

said locking surface being oriented at an angle relative to a plane perpendicular to the axis of said bolt to form a conical shape;

locking means formed on said interior wall defining a mortise opening dimensioned for allowing passage of said front portion of said bolt into said chamber, and for allowing rotational movement of said bolt while said front portion is in said chamber;

a locking wall on said locking means being oriented at an angle relative to a plane perpendicular to the axis of said cylindrical interior wall;

a recess formed in the axial end of said front portion for receiving said cartridge case;

a peripheral extractor groove formed in said bolt extending longitudinally from a portion in said cylindrical body portion to the free end of said front portion;

an extractor pivotally disposed in said groove having an outer surface conforming with the outer surface of said bolt between said cylindrical body portion and said front portion including a section forming part of said locking surface, a holding tab formed on said extractor head arranged for engaging said cartridge case in said recess;

said extractor being biased in a first position in said groove in which said holding tab formed on the extractor head will yield to allow said cartridge case to be received in said recess when said bolt is in said firing position; and whereby during rotation of said bolt in said firing position said locking surface on said bolt including said section of said extractor at the rear end of said front portion of said bolt intimately engage said locking wall at the forward end of said locking means to secure said bolt relative to said receiver with the axis of said bolt and receiver being concentric and prevent pivoting of said extractor to thereby retain said holding tab in engagement with said cartridge case in said firing position.

13. The bolt assembly recited in claim 12 wherein said cylindrical body portion of said bolt further includes a narrowed cylindrical section intermediate said elongated front portion and said cylindrical body portion dimensioned for rotational movement in said mortise opening.

* * * * *